US011795618B2

(12) United States Patent
Straub

(10) Patent No.: US 11,795,618 B2
(45) Date of Patent: Oct. 24, 2023

(54) METHOD FOR PRODUCING A PAPER MACHINE CLOTHING

(71) Applicant: VOITH PATENT GMBH, Heidenheim (DE)

(72) Inventor: Michael Straub, Steinheim (DE)

(73) Assignee: Voith Patent GmbH, Heidenheim (DE)

( * ) Notice: Subject to any disclaimer, the term of this patent is extended or adjusted under 35 U.S.C. 154(b) by 110 days.

(21) Appl. No.: 17/422,221

(22) PCT Filed: Jan. 13, 2020

(86) PCT No.: PCT/EP2020/050661

§ 371 (c)(1),
(2) Date: Jul. 12, 2021

(87) PCT Pub. No.: WO2020/160873

PCT Pub. Date: Aug. 13, 2020

(65) Prior Publication Data

US 2022/0081837 A1 Mar. 17, 2022

(30) Foreign Application Priority Data

Feb. 8, 2019 (DE) ..... 102019103107.9

(51) Int. Cl.
*D21F 7/08* (2006.01)
*D21F 1/00* (2006.01)
*D06M 10/00* (2006.01)

(52) U.S. Cl.
CPC ..... *D21F 7/08* (2013.01); *D06M 10/005* (2013.01); *D21F 1/0063* (2013.01)

(58) Field of Classification Search
CPC ..... D21F 1/0027; D21F 1/0063; D21F 7/08; D06M 10/005
USPC ..... 162/348, 358.2, 900, 903
See application file for complete search history.

(56) References Cited

U.S. PATENT DOCUMENTS 4,446,187 A * 5/1984 Eklund ..... D21F 1/0063 428/137
5,837,102 A * 11/1998 Graf ..... D21F 1/0063 162/903

FOREIGN PATENT DOCUMENTS

| | | | |
|---|---|---|---|
| DE | 102012210768 A1 | | 1/2014 |
| EP | 0 103 376 | * | 3/1984 |
| JP | 2008049398 A | | 3/2008 |
| WO | WO 2014/001217 | * | 1/2014 |

OTHER PUBLICATIONS

WO 2014/001217, Derwent English Language Abstract (Year: 2014).*

* cited by examiner

*Primary Examiner* — Eric Hug
(74) *Attorney, Agent, or Firm* — Laurence A. Greenberg; Werner H. Stemer; Ralph E. Locher

(57) ABSTRACT

A method for producing a paper machine clothing includes the following steps: a) providing a film-like substrate having an upper face and a lower face opposite the upper face; b) forming a pattern of holes in the substrate by boring a multiplicity of holes, which connect the upper face to the lower face, into the substrate by way of at least one laser light source. A bore hole strategy is applied which ensures that, in temporal sequence between the forming of a first hole and an immediately adjacent second hole in the pattern of holes, at least one further hole of the pattern of holes is formed in the substrate which is not immediately adjacent either the first hole or the second hole in the pattern of holes.

15 Claims, 1 Drawing Sheet

METHOD FOR PRODUCING A PAPER MACHINE CLOTHING

BACKGROUND OF THE INVENTION

Field of the Invention

The invention relates to a method for producing a paper machine clothing, comprising the following steps: a) providing a film-like substrate having an upper side and a lower side opposite the upper side and b) introducing a pattern of holes into the substrate by boring a multiplicity of holes connecting the upper side to the lower side into the substrate by means of at least one laser light source.

The term "paper machine clothing" is intended to mean a clothing for a machine for producing or refining a fibrous material web, in particular a paper, cardboard or tissue web. For example, this clothing may be used in the forming part or the pressing part or the drying part of a paper machine. Traditionally, such clothings are currently still substantially produced by weaving methods, that is to say a method in which warp and weft threads are woven together. However, an alternative production method for such paper machine clothings has already been known for a relatively long time. In this method, film-like substrates are perforated by means of a laser. The term "film-like substrates" is in this case intended to mean thin, flat articles which are generally formed by extrusion of plastic. The substrates may in this case be monolithically constructed or formed as a laminate of a plurality of layers. The individual layers may differ from one another in respect of their properties, for example material or thickness. The substrate, or individual layers of the substrate, may also be provided with particles, fibers or yarns in order to impart desired properties to the substrate, particularly in respect of strength. Furthermore, substances, for example a staple fiber layer, may also be applied onto the substrate in order to produce the finished paper machine clothing.

Patent specification U.S. Pat. No. 4,446,187 describes a method of the generic type for perforating a film-like substrate for the purpose of producing a paper machine clothing. As is represented in FIGS. 1 and 2, to this end the film-like substrate 10 is tensioned by means of two rollers 12, the axes of which are aligned parallel with one another. A laser light source 14 is in this case arranged over the film-like substrate 10 and can be moved parallel to the axes of the rollers 12. In order to introduce the desired pattern of holes into the substrate 10, the laser light source 14 initially bores the hole 1' into the substrate 10. The laser light source 14 subsequently travels parallel to the axes of the rollers 12 in order to bore a first row of holes until the last hole 2' of this row is reached. The laser light source 14 is subsequently displaced relative to the substrate 10 in order then to bore the first hole 3' of the next row. In this way, the desired pattern of holes is formed row by row.

Particularly when the paper machine clothing is used as a forming screen, a very large number of very small holes arranged close to one another need to be introduced into the film-like substrate in order to allow maximally uniform and marking-free dewatering of the fibrous material web during the paper production. Depending on the size of the forming screen, the number of holes in the substrate may be in the six or even seven figure range. In the case of the above-described method known from the prior art, it is disadvantageous that a considerable manufacturing time is required for the introduction of so many holes. Although pulsed lasers can nowadays be operated without problems with a very high working frequency, the risk arises that by excessively high energy input into the substrate locally in a short time the material will not only be sublimed where the holes are intended to be introduced, but will also be damaged, in particular melted and/or vaporized, beyond this. This applies particularly to the turning points at the side edges of the substrate.

SUMMARY OF THE INVENTION

It is an object of the present invention to eliminate or at least minimize the above-described problem with the method from the prior art.

This object is achieved according to the invention in that, in the method described in the introduction, a bore hole strategy is applied which ensures that, chronologically between the introduction of a first hole and a second hole immediately adjacent to the first hole in the pattern of holes, at least one further hole, which is not immediately adjacent to the first hole or the second hole in the pattern of holes, of the pattern of holes is introduced into the substrate. This prevents an excessively high amount of energy being introduced into the film-like substrate locally in too short a time, despite a very high working frequency of the laser light source. The manufacturing time during the laser perforation of the film-like substrate can therefore be reduced significantly in comparison with the prior art, without unacceptable damage to the substrate occurring.

The term "not immediately adjacent" is in this case to be understood as meaning that at least one further hole of the pattern of holes is provided between the two holes which are not immediately adjacent. Thus, if for example the midpoints or midaxes of the two holes which are not immediately adjacent are joined to one another with a line, this line therefore extends through at least one further hole of the pattern of holes.

So that unacceptable damage does not occur anywhere in the film-like substrate, and the entire manufacturing process can nevertheless be carried out with a high speed, it is advantageous for the bore hole strategy to be applied to the majority of the holes, preferably to all the holes, of the pattern of holes. If it is applied to all the holes of the pattern of holes, this means that spatially immediately adjacent holes are not introduced chronologically in direct succession into the substrate by means of the laser light source.

In one refinement of the invention, the bore hole strategy provides, chronologically between the introduction of the first hole and the second hole immediately adjacent to the first hole of the pattern of holes, the introduction of at least two further holes, preferably at least three further holes, more preferably at least four further holes into the substrate, all of which are not immediately adjacent to the first hole or the second hole. Preferably, these additionally introduced holes are also not immediately adjacent to one another. In this way, the time spacing between the introduction of two immediately adjacent holes of the pattern of holes may be increased for an equal pulse frequency of the laser light source, or the pulse frequency of the laser light source may be increased without reducing the time spacing between the introduction of two immediately adjacent holes of the pattern of holes.

As an alternative or in addition, for the same reasons, it is proposed for the spatial distance between two holes introduced chronologically in direct succession into the substrate to be at least two times as great, preferably at least three times as great, more preferably at least four times as great as the smallest spatial distance between two immediately adjacent holes in the pattern of holes.

According to one variant for carrying out the bore hole strategy according to the invention, scanner optics, by means of which a laser beam from the laser light source can be displaced in jumps on the substrate, are used, the scanner optics preferably comprising at least one movable mirror. In this way, the manufacturing speed is not limited by the maximum speed with which the laser light source can be moved relative to the film-like substrate. Scanner optics are capable of guiding the laser beam in a fraction of a second from one location on the film-like substrate —within certain spatial limits—onto another location, without the laser light source having to be moved relative to the film-like substrate for this purpose.

Nevertheless, for a further increase in the working speed, it may be advantageous for the laser light source to be moved relative to the substrate during the method. This relative movement may in this case be carried out either substantially discontinuously or substantially continuously. In the first case, the laser light source is kept stationary over the film-like substrate until a predetermined surface region of the film-like substrate, which may for example be reached by means of scanner optics, is provided with holes, before the laser light source is moved relative to the film-like substrate to a further predetermined surface region. In the second case, the laser light source is moved relative to the film-like material while the laser light source introduces holes into the film-like substrate, for example by means of scanner optics. This further increases the working speed in comparison with the first case. For both the continuous and the discontinuous relative movement, it is for example possible for the substrate, which may be tensioned by means of two rollers having axes aligned substantially parallel to one another, to be moved in the machine direction of the future clothing, for example by the rollers being rotated, while the laser light source is moved slowly in the machine transverse direction of the future clothing. In this way, a helical track of holes is obtained on the substrate.

In order to further increase the working speed, more than one laser light source may be used simultaneously in order to introduce holes into the substrate. In this case, each laser light source may be assigned its own scanner optics. The greater the number of laser light sources which are used in parallel is, the greater the working speed is. When using a plurality of laser light sources operating chronologically in parallel, it is also advantageous to apply the bore hole strategy according to the present invention for each individual laser light source.

BRIEF DESCRIPTION OF THE SEVERAL VIEWS OF THE DRAWING

Two exemplary embodiments of the method according to the invention will be described in more detail below with the aid of FIGS. 3 and 4, in which.

DETAILED DESCRIPTION OF THE INVENTION

Figure 1:
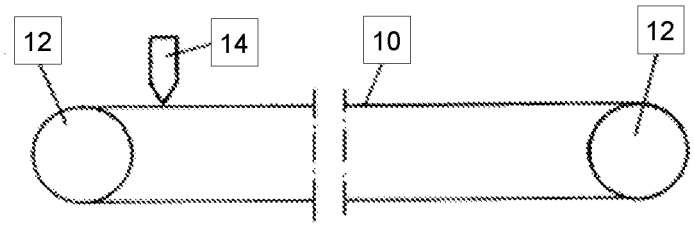
Fig. 1 (Prior Art)
FIG. 1 is a diagrammatic side view of a device showing a prior art method of perforating a substrate.
Figure 2:
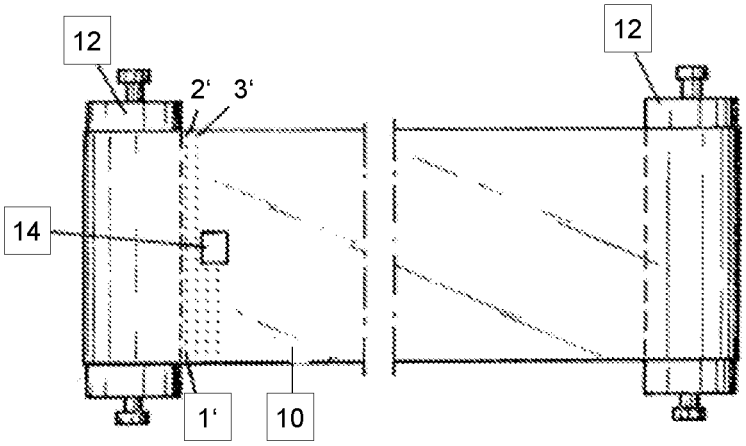
Fig. 2 (Prior Art)
FIG. 2 is a plan view thereof.
Figure 3:
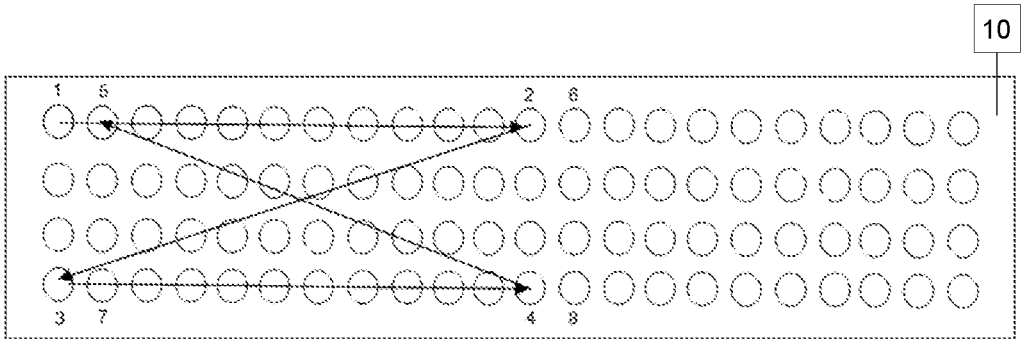
FIG. 3 shows a first exemplary embodiment of the method according to the invention.

FIG. 3 schematically illustrates an exemplary embodiment example of the method according to the invention. A small section of a film-like substrate 10, which has a predetermined pattern of holes, may be seen, the holes of the pattern of holes being introduced into the film-like substrate 10 by means of a laser light source 14. In this case, as represented in FIGS. 1 and 2 and described in the introduction in connection with the prior art, the substrate 10 may be tensioned by means of two rollers 12, the laser light source 14 being arranged movably relative to the substrate 10, parallel to the axes of the rollers 12. Unlike in the embodiment known from the prior art, however, here the holes are not introduced successively into the substrate in a row. Rather, scanner optics (not represented) are used, which make it possible to cause a laser beam from the laser light source 14 to jump within a very short time from one location on the surface of the film-like substrate 10 to another location of the surface. In the present example, the scanner optics encompass the entire section, represented in FIG. 3, of the substrate 10.

The chronological order with which the holes 1-8 of the pattern of holes are introduced into the film-like substrate is represented by the arrows and the numbering in FIG. 3. Assuming that the left edge of the section shown in FIG. 3 corresponds to one of the two side edges of the film-like substrate 10, a first hole 1 is introduced into the film-like substrate 10 in the vicinity of the side edge. Subsequently, the scanner optics ensure that, although the second hole 2 is introduced in the same row as the first hole 1, the hole 2 is not immediately adjacent to the hole 1. Rather, in this embodiment example 10 holes of the pattern of holes are arranged between the hole 1 and the hole 2. After the introduction of the hole 2, the scanner optics ensure that the next hole 3 is likewise introduced at a position which is not immediately adjacent to the hole 2. Rather, in this embodiment example the hole 3 is introduced four rows below the hole 1. The next hole 4 is in turn not introduced immediately adjacent to the hole 3. Rather, although it is introduced in the fourth row, i.e. the row of hole 3, it is introduced below hole 2, so that in this embodiment example 10 further holes of the pattern of holes are arranged between hole 3 and hole 4. The same jump sequence is subsequently repeated, but shifted by one hole to the right in FIG. 3. Therefore hole 5 is introduced immediately adjacent to hole 1 in the first row. Hole 6 is introduced immediately adjacent to hole 2 in the first row. Hole 7 is introduced immediately adjacent to hole 3 in the fourth row. Hole 8 is introduced immediately adjacent to hole 4 in the fourth row. The scheme is repeated until all holes between hole 1 and hole 2 in the first row have been introduced into the film-like substrate 10, i.e., until all the holes represented in FIG. 3 in rows 1 and 4 have been generated. Following this, the laser light source 14 is moved to the right relative to the substrate 10, outside the image region of FIG. 3, in order to perforate the first and fourth rows of a further section of the film-like substrate 10 there. As soon as the opposite side edge of the film-like substrate 10 is reached, the film-like substrate 10 may be moved forward by means of the rollers 12 so that the next rows, for example rows 2 and 5, can be introduced according to the bore hole strategy according to the invention, until the entire film-like substrate 10 is provided with the predetermined pattern of holes.

Figure 4:
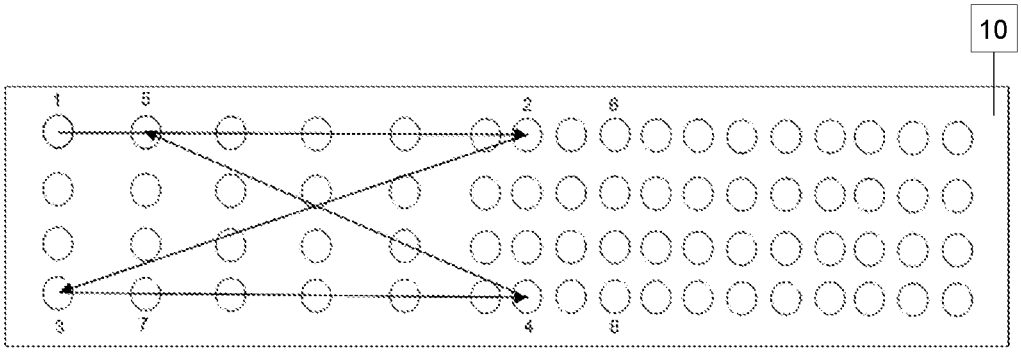
FIG. 4 shows a second exemplary embodiment of the method according to the invention.

FIG. 4 schematically illustrates an alternative second exemplary embodiment example of the method according to the invention. It differs from the first embodiment example in that two times the distance in comparison with the first embodiment example is left between the holes 1 and 5 as well as between the holes 2 and 6 in the first row, and between the holes 3 and 7 as well as between the holes 4 and 8 in the fourth row. The effect of this is on the one hand that the introduction of the holes in the first and fourth rows can take place substantially continuously over the entire length of these rows when the laser light source 14 is moved constantly relative to the film-like substrate 10, parallel to the axes of the two rollers 12. This has the advantage that the method can be carried out even more rapidly than in the case of the first embodiment example, in which the rows are introduced in sections and therefore substantially discontinuously.

On the other hand, the effect of the method according to the second embodiment example is that the hole spacing in the edge region of the film-like substrate 10 (on the left in FIG. 3) is greater than in the central region of the substrate 10 (on the right in FIG. 3). This is advantageous since the substrate 10 in this way has a greater strength in the edge region. In this case, it should be noted that in the edge region of the substrate 10 it is less important for the holes to lie close to one another, since accurate formation of the fibrous material web is not essential in this region. Usually, no fibrous material at all is applied onto this region.

By the method according to the invention, it is possible to perforate the film-like substrate 10 much more rapidly than with the method described in the introduction from the prior art, since the individual holes can be introduced more rapidly in succession without the substrate 10 locally experiencing a critical energy input and being damaged.

LIST OF REFERENCES

1', 2', 3' holes
1-8 holes
10 film-like substrate
12 roller
14 laser light source

The invention claimed is:

1. A method of producing a paper machine clothing, comprising the following steps:

providing a film-like substrate having an upper side and a lower side opposite the upper side;

forming a pattern of holes in the substrate by boring a multiplicity of holes connecting the upper side with the lower side into the substrate with at least one laser light source;

in the forming step, applying a bore hole strategy which ensures that, chronologically between an introduction of a first hole and a second hole that is immediately adjacent the first hole in the pattern of holes, at least one further hole of the pattern of holes is introduced into the substrate which is not immediately adjacent the first hole or the second hole in the pattern of holes; and wherein a spacing distance between two holes that are introduced chronologically in direct succession into the substrate is at least two times as great as a smallest spacing distance between two immediately adjacent holes in the pattern of holes.

2. The method according to claim 1, which comprises applying the bore hole strategy to a majority of the holes of the pattern of holes.

3. The method according to claim 2, which comprises applying the bore hole strategy to all the holes of the pattern of holes.

4. The method according to claim 1, wherein the at least one further hole is one of at least two further holes and the bore hole strategy provides, chronologically between the introduction of the first hole and the second hole immediately adjacent the first hole, for introducing the at least two further holes into the substrate, with none of the at least two further holes being immediately adjacent the first hole or the second hole.

5. The method according to claim 1, wherein the at least one further hole is one of at least three further holes and the bore hole strategy provides, chronologically between the introduction of the first hole and the second hole immediately adjacent the first hole, for introducing the at least three further holes into the substrate, with none of the at least three further holes being immediately adjacent the first hole or the second hole.

6. The method according to claim 1, wherein the at least one further hole is one of at least four further holes and the bore hole strategy provides, chronologically between the introduction of the first hole and the second hole immediately adjacent the first hole, for introducing the at least four further holes into the substrate, with none of the at least four further holes being immediately adjacent the first hole or the second hole.

7. The method according to claim 1, wherein the spacing distance between the two holes that are introduced chronologically in direct succession into the substrate is at least three times or at least four times as great as the smallest spacing distance between the two immediately adjacent holes in the pattern of holes.

8. The method according to claim 1, which comprises moving the laser light source relative to the substrate during the forming step.

9. The method according to claim 8, which comprises carrying out a movement of the laser light source relative to the substrate substantially discontinuously.

10. The method according to claim 8, which comprises carrying out a movement of the laser light source relative to the substrate substantially continuously.

11. The method according to claim 8, which comprises tensioning the substrate during the forming step by way of at least two rotatable rollers having mutually parallel roller axes.

12. The method according to claim 11, which comprises arranging the laser light source over the substrate and moving the laser light source relative to the substrate parallel to the roller axes.

13. The method according to claim 1, wherein the at least one laser light source is one of a plurality of laser light sources and the forming step comprises simultaneously using the plurality of laser light sources in order to introduce holes into the substrate.

14. A method of producing a paper machine clothing, comprising the following steps:

providing a film-like substrate having an upper side and a lower side opposite the upper side;

forming a pattern of holes in the substrate by boring a multiplicity of holes connecting the upper side with the lower side into the substrate with at least one laser light source;

in the forming step, applying a bore hole strategy which ensures that, chronologically between an introduction of a first hole and a second hole that is immediately adjacent the first hole in the pattern of holes, at least one further hole of the pattern of holes is introduced into the substrate which is not immediately adjacent the first hole or the second hole in the pattern of holes; and using scanner optics for displacing a laser beam from the laser light source in jumps on the substrate, for carrying out the bore hole strategy.

15. The method according to claim 14, wherein the scanner optics comprises at least one movable mirror.

* * * * *